US008378273B2

(12) United States Patent
Sekiguchi et al.

(10) Patent No.: US 8,378,273 B2
(45) Date of Patent: Feb. 19, 2013

(54) CERAMIC HEATER AND GLOW PLUG

(75) Inventors: Yutaka Sekiguchi, Ichinomiya (JP); Yoshihito Ikai, Tsushima (JP); Takeshi Mitsuoka, Kounan (JP)

(73) Assignee: NGK Spark Plug Co., Ltd., Aichi (JP)

( * ) Notice: Subject to any disclaimer, the term of this patent is extended or adjusted under 35 U.S.C. 154(b) by 281 days.

(21) Appl. No.: 12/865,909

(22) PCT Filed: Feb. 19, 2009

(86) PCT No.: PCT/JP2009/000707

§ 371 (c)(1),
(2), (4) Date: Aug. 3, 2010

(87) PCT Pub. No.: WO2009/104401

PCT Pub. Date: Aug. 27, 2009

(65) Prior Publication Data

US 2011/0114622 A1 May 19, 2011

(30) Foreign Application Priority Data

Feb. 20, 2008 (JP) ..... 2008-039203
Dec. 25, 2008 (JP) ..... 2008-330796

(51) Int. Cl.
*H05B 3/10* (2006.01)

(52) U.S. Cl. ..... 219/552; 219/544; 219/270

(58) Field of Classification Search ..... 219/552, 219/544, 270

See application file for complete search history.

(56) References Cited

U.S. PATENT DOCUMENTS

| | | | | | |
|---|---|---|---|---|---|
| 4,125,761 | A | * | 11/1978 | Churchill | 219/544 |
| 4,563,568 | A | * | 1/1986 | Takizawa | 219/270 |
| 4,636,614 | A | * | 1/1987 | Itoh et al. | 219/270 |
| 4,810,853 | A | * | 3/1989 | Maruta et al. | 219/270 |
| 4,929,813 | A | * | 5/1990 | Masaka et al. | 219/270 |
| 5,086,210 | A | * | 2/1992 | Nunogaki et al. | 219/270 |
| 5,218,183 | A | * | 6/1993 | Kimata | 219/270 |
| 5,750,958 | A | * | 5/1998 | Okuda et al. | 219/267 |
| 5,883,360 | A | * | 3/1999 | Tatematsu et al. | 219/270 |
| 6,013,898 | A | * | 1/2000 | Mizuno et al. | 219/270 |
| 6,111,223 | A | * | 8/2000 | Tatematsu | 219/270 |
| 6,236,148 | B1 | * | 5/2001 | Nasu et al. | 313/141 |
| 6,274,853 | B1 | * | 8/2001 | Watanabe et al. | 219/538 |
| 6,359,261 | B1 | * | 3/2002 | Watanabe et al. | 219/270 |
| 6,433,311 | B1 | * | 8/2002 | Teramura et al. | 219/270 |

(Continued)

FOREIGN PATENT DOCUMENTS

| | | | |
|---|---|---|---|
| EP | 1255075 | A2 * | 11/2002 |
| EP | 1255076 | A2 * | 11/2002 |

(Continued)

*Primary Examiner* — Laura Menz
(74) *Attorney, Agent, or Firm* — Sughrue Mion, PLLC

(57) ABSTRACT

A ceramic heater (12) includes a substrate (60) and a resistor element (30) buried in the substrate (60). The resistor element (30) includes a heat-generating portion (33), lead portions (31), and intermediate portions (40) located between the heat-generating portions (33) and the lead portions (31). The intermediate portions (40) are formed such that, when cross sections at arbitrary two points P1 and P2 along the axis XA direction are compared, both the diameter CL of an imaginary circumscribed circle CG containing cross sections of the resistor element 30 and the total cross sectional area HS of the cross sections become small in the front end side cross section as compared with those in the rear end side cross section.

9 Claims, 8 Drawing Sheets

U.S. PATENT DOCUMENTS

| | | | | |
|---|---|---|---|---|
| 6,483,079 | B2 * | 11/2002 | Sato et al. | 219/270 |
| 6,563,089 | B2 * | 5/2003 | Watanabe et al. | 219/270 |
| 6,621,052 | B2 * | 9/2003 | Watanabe et al. | 219/270 |
| 6,646,231 | B2 * | 11/2003 | Hotta et al. | 219/270 |
| 6,653,601 | B2 * | 11/2003 | Taniguchi et al. | 219/270 |
| 6,657,166 | B2 * | 12/2003 | Funaki et al. | 219/270 |
| 6,689,990 | B2 * | 2/2004 | Taniguchi et al. | 219/270 |
| 6,720,530 | B2 * | 4/2004 | Taniguchi et al. | 219/270 |
| 6,737,612 | B2 * | 5/2004 | Taniguchi et al. | 219/270 |
| 6,759,631 | B1 * | 7/2004 | Geissinger et al. | 219/270 |
| 6,770,850 | B2 * | 8/2004 | Taniguchi et al. | 219/270 |
| 6,849,207 | B2 * | 2/2005 | Funaki et al. | 252/516 |
| 6,881,930 | B2 * | 4/2005 | Yoshikawa et al. | 219/270 |
| 7,020,952 | B2 * | 4/2006 | Watanabe et al. | 29/613 |
| 7,122,947 | B2 * | 10/2006 | Nasu et al. | 313/141 |
| 7,201,043 | B2 * | 4/2007 | Yamada et al. | 73/114.21 |
| 7,282,670 | B2 * | 10/2007 | Matsubara et al. | 219/270 |
| 8,013,278 | B2 * | 9/2011 | Kurono et al. | 219/552 |
| 2002/0036192 | A1 * | 3/2002 | Sato et al. | 219/270 |
| 2002/0043524 | A1 * | 4/2002 | Taniguchi et al. | 219/270 |
| 2002/0096802 | A1 * | 7/2002 | Watanabe et al. | 264/332 |
| 2002/0113052 | A1 * | 8/2002 | Watanabe et al. | 219/270 |
| 2002/0117492 | A1 * | 8/2002 | Teramura et al. | 219/270 |
| 2002/0134774 | A1 * | 9/2002 | Funaki et al. | 219/270 |
| 2002/0148823 | A1 * | 10/2002 | Watanabe et al. | 219/270 |
| 2002/0162830 | A1 * | 11/2002 | Taniguchi et al. | 219/270 |
| 2002/0162831 | A1 * | 11/2002 | Taniguchi et al. | 219/270 |
| 2002/0162834 | A1 * | 11/2002 | Asano et al. | 219/541 |
| 2002/0175155 | A1 * | 11/2002 | Funaki et al. | 219/270 |
| 2002/0175156 | A1 * | 11/2002 | Hotta et al. | 219/270 |
| 2003/0029857 | A1 * | 2/2003 | Taniguchi et al. | 219/270 |
| 2003/0042242 | A1 * | 3/2003 | Taniguchi et al. | 219/270 |
| 2003/0042243 | A1 * | 3/2003 | Taniguchi et al. | 219/270 |
| 2003/0126736 | A1 * | 7/2003 | Watanabe et al. | 29/611 |
| 2004/0178185 | A1 * | 9/2004 | Yoshikawa et al. | 219/270 |
| 2004/0183419 | A1 * | 9/2004 | Nasu et al. | 313/141 |
| 2005/0274707 | A1 * | 12/2005 | Matsubara et al. | 219/270 |
| 2005/0284859 | A1 * | 12/2005 | Konishi | 219/270 |
| 2006/0011602 | A1 * | 1/2006 | Konishi et al. | 219/270 |
| 2007/0210053 | A1 * | 9/2007 | Hotta et al. | 219/270 |
| 2007/0221661 | A1 * | 9/2007 | Nagasako et al. | 219/544 |
| 2007/0241092 | A1 * | 10/2007 | Suzuki | 219/260 |
| 2008/0142496 | A1 * | 6/2008 | Itoh et al. | 219/270 |
| 2009/0008383 | A1 * | 1/2009 | Kurono et al. | 219/553 |
| 2009/0194519 | A1 * | 8/2009 | Funaki et al. | 219/270 |
| 2009/0320782 | A1 * | 12/2009 | Hiura | 123/145 A |
| 2010/0000982 | A1 * | 1/2010 | Allgaier et al. | 219/270 |
| 2010/0155389 | A1 * | 6/2010 | Yamamoto | 219/548 |
| 2010/0213188 | A1 * | 8/2010 | Nishihara et al. | 219/544 |
| 2010/0288747 | A1 * | 11/2010 | Yamamoto | 219/270 |
| 2011/0068091 | A1 * | 3/2011 | Hiura | 219/270 |
| 2011/0114622 | A1 * | 5/2011 | Sekiguchi et al. | 219/270 |
| 2011/0240625 | A1 * | 10/2011 | Takenouchi | 219/260 |
| 2011/0253704 | A1 * | 10/2011 | Yamamoto | 219/544 |

FOREIGN PATENT DOCUMENTS

| | | | | |
|---|---|---|---|---|
| EP | 1288572 | A2 | * | 3/2003 |
| EP | 1288573 | A2 | * | 3/2003 |
| EP | 1998595 | A1 | * | 12/2008 |
| EP | 1998596 | A1 | * | 12/2008 |
| EP | 2117280 | A1 | * | 11/2009 |
| EP | 2219414 | A1 | * | 8/2010 |
| EP | 2247156 | A1 | * | 11/2010 |
| EP | 2257119 | A1 | * | 12/2010 |
| JP | 61-225517 | A | | 10/1986 |
| JP | 4-370689 | A | | 12/1992 |
| JP | 07-239123 | A | | 9/1995 |
| JP | 09137945 | A | * | 5/1997 |
| JP | 10300083 | A | * | 11/1998 |
| JP | 10300086 | A | * | 11/1998 |
| JP | 3044632 | B2 | | 5/2000 |
| JP | 2000327426 | A | * | 11/2000 |
| JP | 2001132947 | A | * | 5/2001 |
| JP | 2001132949 | A | * | 5/2001 |
| JP | 2001132950 | A | * | 5/2001 |
| JP | 2002203665 | A | * | 7/2002 |
| JP | 2002246153 | A | * | 8/2002 |
| JP | 2002257341 | A | * | 9/2002 |
| JP | 2002333136 | A | * | 11/2002 |
| JP | 2002-364847 | A | | 12/2002 |
| JP | 2002349852 | A | * | 12/2002 |
| JP | 2002349853 | A | * | 12/2002 |
| JP | 2003022889 | A | * | 1/2003 |
| JP | 2003074849 | A | * | 3/2003 |
| JP | 2004061041 | A | * | 2/2004 |
| JP | 2006-024394 | A | | 1/2006 |
| JP | 2006049279 | A | * | 2/2006 |
| JP | 2006127995 | A | * | 5/2006 |
| JP | 2006351446 | A | * | 12/2006 |
| JP | 2008235034 | A | * | 10/2008 |
| JP | 2009231161 | A | * | 10/2009 |
| JP | 2009287920 | A | * | 12/2009 |
| JP | 2010073417 | A | * | 4/2010 |
| JP | 2012033340 | A | * | 2/2012 |

* cited by examiner

CERAMIC HEATER AND GLOW PLUG

TECHNICAL FIELD

This invention relates to a ceramic heater and a glow plug, and, more specifically, to a ceramic heater and a glow plug which have excellent quick heating performance, can reduce power consumption, and are also excellent in durability, all being realized at high levels. This invention realizes a ceramic heater and a glow plug which exhibit particularly excellent durability when the ceramic heater and the glow plug are increased in temperature within a shorter time than in the past (also called "super quick temperature raising").

BACKGROUND ART

In order to assist startup or allow quick activation, diesel engines, various types of sensors, etc. employ a glow plug, a heater for a sensor, a heater for a fan, and the like. For example, in a diesel engine, air taken into a cylinder is compressed, and fuel is injected into the air whose temperature has increased as a result of adiabatic compression, whereby a resultant air fuel mixture spontaneously ignites and burns. However, in a case where such a diesel engine is started in winter or in a cold environment or a like case, since the temperatures of outside air, the engine, etc. are low, it is not easy to heat, only by means of compression, the air within the combustion chamber to a temperature required for spontaneous ignition. In order to overcome such a problem, a glow plug is used in such a diesel engine as means for igniting fuel.

A known heater which is used as a heater for a glow plug, a heater for a sensor, a heater for a fan, or the like has a structure in which a heating resistor element formed of, for example, an electrically conductive ceramic is embedded in an electrically insulative ceramic substrate. Specifically, Patent Document 1 discloses a ceramic-heater-type glow plug in which a resistor element formed of different types of electrically conductive ceramics which differ from each other in temperature coefficient of resistance is embedded in a substrate formed of an electrically insulative ceramic. As described above, Patent Document 1 proposes provision of a ceramic-heater-type glow plug which has quick heating performance and a self temperature controlling function, by means of combining resistor elements having different resistivities.

In the case of a glow plug, in order to realize quick heating performance and perform fine temperature control, a controller is used to control supply of electricity to the glow plug. However, at the time of startup, the voltage of a battery may drop in some cases, with a resultant failure to supply a sufficiently high voltage to the glow plug. In order to overcome such a drawback, a glow plug having low resistance may be used. However, in this case, since the resistance of the glow plug at room temperature is low, a large rush current flows when the supply of electricity is started. This problem can be solved through combined use of different materials having different resistances. Specifically, the resistor element may be configured such that only a front end side portion (heat-generating portion) of the resistor element is formed of a material having a relatively high resistivity, and a rear end side portion (including lead portions) of the resistor element is formed of a material having a relatively low resistivity. However, since this configuration increases cost, if possible, it is desirable to realize quick heating performance through sole use of a single material.

Patent Document 2 discloses a ceramic heater designed to reduce power consumption. The disclosed ceramic heater is characterized in that a heat-generating portion and lead portions of the ceramic heater are formed of the same electrically conductive ceramic, and the ratio of cross sectional area therebetween is determined to fall within a predetermined range. The document states that this configuration reduces power consumption. However, when the ratio of cross sectional area is increased, the surface temperature of a support member varies greatly among positions in its cross section. This problem can be mitigated by proper setting of the ratio of cross sectional area. However, when the temperature at the surface of the support member (substrate) is desired to be more uniform, the temperature of the interior (resistor element) of the support member must be increased excessively such that a portion on the surface of the support member which is low in temperature is heated to such a degree as to provide a satisfactory heating function of the ceramic heater. In such a case, energization durability (the durability of the ceramic heater as determined through a durability test in which the ceramic heater is energized repeatedly) may drop. That is, since a tradeoff relation exists between power consumption and energization durability, improving the power consumption and the energization durability simultaneously is actually difficult although its technical significance is large.

Incidentally, in the case of the ceramic heaters disclosed in Patent Documents 1 and 2, their heat-generating portions (a "first heating element 20" in Patent Document 1 and a "folded portion 3*d*" in Patent Document 2) assume a shape as shown in FIG. 9 such that a relatively long heat-generating front end portion 50 formed into a U-like shape is disposed along and in the vicinity of the outline of the substrate. Since it has been assumed that such a shape allows uniform, efficient heating of the substrate to thereby provide excellent quick heating performance and reduce power consumption, the heat-generating portion is formed into a U-like shape such that it is disposed along and in the vicinity of the outline of the substrate. However, when the present inventors made a resistor element having a shape different from the conventional shape assumed to provide excellent quick heating performance and reduce power consumption, the inventors found that, contrary to their expectations, the resistor element that they made has excellent quick heating performance, can reduce power consumption, and has improved durability.

Further, in recent years, a ceramic heater for glow plug has been demanded to have improved heating performance and durability and to further reduce power consumption. In particular, such a ceramic heater has been demanded to further reduce power consumption, while securing a sufficient amount of heat radiation in order to prevent deterioration in the startup performance of an engine. In addition, there has been increasing demand for a ceramic heater which has an excellent durability, can realize a temperature increasing performance such that the heater can reach 1000° C. within 1 sec upon supply of a small amount of power (also called "super quick temperature raising") in order to contribute to new engine control, and can maintain such temperature increasing performance even when the power supply voltage drops to, for example, about 7 V.

Patent Document 1: Japanese Patent No. 3044632

Patent Document 2: Japanese Patent Application Laid-Open (kokai) No. 2006-24394

DISCLOSURE OF THE INVENTION

Problems to be Solved by the Invention

An object of this invention is to provide a ceramic heater and a glow plug which have excellent quick heating performance, can reduce power consumption, and are excellent in durability. In particular, an object of this invention is to provide a ceramic heater and a glow plug which have practical durability even when they are used for super quick temperature raising which imposes a large load on the ceramic heater and the glow plug.

Means for Solving the Problems

A ceramic heater according to the present invention which solves the above-described problem comprises a substrate formed of an electrically insulative ceramic, and a resistor element buried in the substrate, wherein the resistor element includes a single heat-generating portion formed of an electrically conductive ceramic and folded into a U-like shape, and a pair of lead portions which are joined to opposite end portions of said heat-generating portion, the end portion facing rearward with respect to a direction of an axis XA, and which extend straight rearward with respect to the direction of the axis XA. A first structural feature of the ceramic heater resides in that said resistor element includes intermediate portions located between said heat-generating portion and said lead portions;

when, on cross section $S_1$ and $S_2$ of said ceramic heater taken along a plane perpendicular to said axis XA at a front end side point $P_1$ and a rear end side point $P_2$, which are arbitrary two different points on said axis XA, imaginary circumscribed circles $CG_1$ and $CG_2$ are drawn such that the imaginary circumscribed circles $CG_1$ and $CG_2$ circumscribe and contain two cross sections $HS_{1a}$ and $HS_{1b}$ and two cross sections $HS_{2a}$ and $HS_{2b}$, respectively, of said resistor element appearing on the cross section $S_1$ and $S_2$, respectively, diameter $CL_1$ and $CL_2$ of the circumscribed circles $CG_1$ and $CG_2$ satisfy a relation $CL_1<CL_2$; and the total cross sectional area $HS_{1S}$ of the two cross sections $HS_{1a}$ and $HS_{1b}$ of said resistor element and the total cross sectional area $HS_{2S}$ of the two cross sections $HS_{2a}$ and $HS_{2b}$ of said resistor element satisfy a relation $HS_{1S}<HS_{2S}$.

A second structural feature of said ceramic heater having said first structural feature resides in that the cross sectional areas $S_{1S}$ and $S_{2S}$ of the cross sections $S_1$ and $S_2$ of said ceramic heater satisfy a relation $S_{1S}<S_{2S}$.

A third structural feature of said ceramic heater having said first or second structural feature resides in that said ceramic heater is inserted into and held in a tubular member formed of metal such that a front end portion of said ceramic heater is exposed;

each of said intermediate portions has a portion having a thickness $t_{XVex}$ equal to or less than ⅔ a maximum thickness $tx_{XVmax}$ of said resistor element; and a portion of said resistor element whose thickness is $2(t_{XVmax})/3$ is exposed from said tubular member formed of metal.

A fourth structural feature of said ceramic heater having any one of said first through third structural features resides in that a relation $\theta_2>\theta_1$ and a relation $L_1>L_2$ are satisfied, where $\theta_1$ represents an angle formed between said axis XA and each of radially outer side outlines of said intermediate portions which outlines determine a width of said intermediate portions, $L_1$ represents a length of said intermediate portions as measured along the direction of said axis XA, $\theta_2$ represents a largest angle among angles formed between said axis XA and radially outer side outlines of said intermediate portions which outlines determine a thickness of said intermediate portions, and $L_2$ represents a length of the outlines of said intermediate portions forming the largest angle, as measured along the direction of said axis XA.

A fifth structural feature of said ceramic heater having any one of said second through fourth structural features resides in that an outline of said substrate in which the portions of said intermediate portions having the thickness $t_{XVvex}$ are buried is tapered off toward the front end thereof.

A sixth structural feature of said ceramic heater having any one of said second through fifth structural features resides in that said angle $\theta_1$ and an angle $\theta_3$ satisfy a relation $|\theta_3-\theta_1|\leqq 10°$, where the angle $\theta_3$ represents an angle formed, in a XV direction view, between said axis XA and an outline of said substrate at a position along the direction of said axis XA where said intermediate portions are located.

A seventh structural feature of said ceramic heater having any one of said first through sixth structural features resides in that a maximum spacing GL between said pair of lead portions and a maximum spacing GM between said intermediate portions having the thickness $t_{XVex}$ satisfy a relation GL<GM.

A glow plug according to the present invention comprises a ceramic heater having the above-described structure.

Effects of the Invention

Since the ceramic heater according to the present invention is formed such that its heat-generating portion has intermediate portions configured as described above, the heat-generating portion can have a reduced volume, has excellent quick heating performance, can reach a predetermined temperature through consumption of a small amount of electric power, and can avoid concentration of stresses or the like forces produced, for example, as a result of thermal expansion when a voltage is applied to the ceramic heater, whereby the ceramic heater exhibits enhanced energization durability and mechanical durability. Therefore, the present invention can provide a ceramic heater which has excellent quick heating performance, can reduce power consumption, and is excellent in durability. Further, since the glow plug according to the present invention includes a ceramic heater according to the present invention, the glow plug according to the present invention can realize quick heating performance, low power consumption, and durability at higher levels.

BEST MODE FOR CARRYING OUT THE INVENTION

A ceramic heater which is one embodiment of the ceramic heater according to the present invention will be described with reference to the drawings. FIG. 1 is a schematic perspective view showing a ceramic heater 12 which is one embodiment of the ceramic heater according to the present invention. FIG. 2 is a schematic cross sectional view of the ceramic heater 12 shown in FIG. 1, taken along a plane containing an axis XA. As shown in FIGS. 1 and 2, this ceramic heater 12 includes a bar-shaped substrate 60 extending along the direction of the axis XA (hereinafter may be referred to as the axis XA direction), and a resistor element 30 embedded in the substrate 60. Notably, in FIG. 2, a tubular member 90, which is used to constitute a glow plug 200 to be described later, is depicted by a broken line.

The resistor element 30 includes a single heat-generating portion 33 having a U-shaped folded portion on the front end side with respect to the direction of the axis XA of the substrate 60, and a pair of lead portions 31, 31 connected to corresponding rear ends of the heat-generating portion 33 and extending in the axis XA direction. The pair of lead portions 31, 31 are located on opposite sides of the axis XA of the substrate 60, and extend, in generally parallel with each other, along the axis XA to a rear end surface 75 of the substrate 60, so that the lead portions 31, 31 are exposed on the rear end surface 75 of the substrate 60. As shown in FIG. 2, the lead portions 31, 31 have respective electrode takeout portions 77 and 78, which are exposed on an outer circumferential surface of the substrate 60. Notably, the heat-generating portion 33 and the lead portions 31, 31 are connected together by means of intermediate portions 40, 40. The configuration of the intermediate portions 40, 40 will be described later.

Next, the shape of the front end portion of the ceramic heater 12 will be described. FIG. 3(*b*) is an enlarged view of a cross section of the front end portion of the ceramic heater 12 which passes through the axis XA, as viewed, as in the case of FIG. 2, in a direction in which the U-like shape of the heat-generating portion 33 can be recognized and the width of the resistor element 30 can be recognized (that is, in a direction perpendicular to the sheets on which FIG. 2 and FIG. 3(*a*) are depicted; hereinafter, this direction will also be referred to as the "XV direction"). FIG. 3(*c*) is an enlarged view of a cross section of the front end portion of the ceramic heater 12, as viewed in a direction perpendicular to the XV direction and the axis XA (hereinafter, this direction will also be referred to as the "XH direction"). Notably, although a portion actually appearing in FIG. 3(*b*) is only the cross section of the frontmost end portion of the heat-generating portion 33 of the resistor element 30, for the sake of description, the outlines of the heat-generating portion 33, the intermediate portions 40, and the lead portions 31 are also projected on the cross section of FIG. 3(*b*). Therefore, the XH direction can also be said to be a direction in which the thickness of the resistor element 30 can be recognized. FIG. 3(*c*) shows a cross section S of the paired intermediate portions 40, 40, taken along a plane perpendicular to the axis XA at an arbitrary point P along the axis XA direction.

With reference to FIGS. 3 and 4, the intermediate portions 40 will be described in detail. This pair of intermediate portions 40, 40 satisfy the conditions of the above-described first structural feature. That is, in FIG. 3(*a*), positions $P_1$ and $P_2$ are set along the axis XA direction. FIGS. 4(*a*) and 4(*b*) show cross sections $S_1$ and $S_2$ corresponding to these positions $P_1$ and $P_2$. $S_{1S}$ and $S_{2S}$ represent the cross sectional areas of the cross section $S_1$ and $S_2$ (including the cross sectional areas of the intermediate portions 40 (the resistor element 30)). ($HS_{1a}$, $HS_{1b}$) and ($HS_{2a}$, $HS_{2b}$) represent the cross sections of the resistor element 30 at the positions $P_1$ and $P_2$, and $HS_{1S}$ and $HS_{2S}$ represent the cross sectional areas of the cross sections (the total cross sectional areas of the cross sections) at the positions $P_1$ and $P_2$. Notably, $CG_1$ and $CG_2$ represent imaginary circumscribed circles which contain the pair of cross sections ($HS_{1a}$, $HS_{1b}$) and ($HS_{2a}$, $HS_{2b}$), respectively, and $CL_1$ and $CL_2$ represent the diameters of these imaginary circumscribed circles. Further, $CN_1$ and $CN_2$ represent imaginary inscribed circles which are in contact with the pair of cross sections ($HS_{1a}$, $HS_{1b}$) and ($HS_{2a}$, $HS_{2b}$), respectively, and $CD_1$ and $CD_2$ represent the diameters of these imaginary inscribed circles.

The following effects are achieved because of presence of the intermediate portions 40, 40 in which the diameters of the imaginary circumscribed circle $CG_1$ and $CG_2$ satisfy a relation $CL_1<CL_2$ and the total cross sectional areas $HS_{1S}$ and $HS_{2S}$ of the cross sections ($HS_{1a}$, $HS_{1b}$), ($HS_{2a}$, $HS_{2b}$) of the resistor element 30 satisfy a relation $HS_{1S}<HS_{2S}$. That is, since the volumes of the intermediate portions 40, 40 and the heat-generating front end portion 50 decrease, stresses stemming from thermal expansion of the pair of lead portions 31, 31 produced upon application of voltage to the resistor element 30, stresses produced at the time of handling, and other stresses acting on the resistor element 30 are gradually absorbed by the pair of intermediate portions 40, 40, and concentration of these stresses on the heat-generating front end portion 50 can be avoided. Further, since the volume of the heat-generating front end portion 50 decreases, the heat-generating front end portion 50 has more excellent quick heating performance, can reach a predetermined temperature while consuming a slight amount of electric power, and can prevent fracture of the heat-generating front end portion 50, which fracture would otherwise occur due to the above-mentioned stresses. As a result, the resistor element 30; in particular, the heat-generating portion 33, has excellent quick heating performance, can reach a predetermined temperature while consuming a slight amount of electric power, and can have enhanced energization durability and mechanical durability. When electricity is supplied to the ceramic heater 12 so as to cause the ceramic heater 12 to generate heat, the temperature of the heater becomes the highest in a hottest heat-generating portion 55 at which the total cross sectional area of the resistor element 30 and the cross sectional area of the ceramic heater 12 (including the resistor element 30) in a cross section perpendicular to the axis XA direction become the smallest.

The boundaries of the intermediate portions 40, 40 will be described in detail. Since portions in which the cross sections at two different arbitrary points along the axis XA direction satisfy the above-described relations are the intermediate portions, points at which the cross sections fail to satisfy the above-described relations can be the boundaries of the intermediate portions 40, 40. This will be described specifically with reference to FIG. 3(*a*).

A point $Q_a$ is a point along the axis XA direction in the heat-generating portion 33 (the front end portion) of the resistor element 30. A point $P_a$ located rearward of this point $Q_a$ is a base point from which an outline 40*g* on the outer side of the resistor element 30 with respect to the radial direction (hereinafter, the radial direction may be referred to as the "XD direction) starts to expand toward the rear end. From comparison between the cross sectional shapes at these two points $Q_a$ and $P_a$, it is found that the imaginary circumscribed circle containing the pair of cross sections of the resistor element 30 at the point $Q_a$ and that at the point $P_a$ have the same diameter. Further, the total cross sectional area of the pair of cross sections of the resistor element 30 at the point $Q_a$ and that at the point $P_a$ are the same. Therefore, portions between the points $Q_a$ and $P_a$ do not correspond to the intermediate portions (that is, the portions are parts of the heat-generating portion).

Next, the point $P_a$ and a point $P_1$ in FIG. 3(*a*) are compared. As described above, the resistor element 30 expands rearward from the point $P_a$ (base point). Therefore, at the point $P_1$, the diameter of the imaginary circumscribed circle is larger than that at the point $P_a$. Further, with this, the total cross sectional area of the resistor element 30 also increases. Therefore, the portions between the points $P_a$ and $P_1$ correspond to the intermediate portions.

Meanwhile, the lead portions 31, which are approximately constant in cross sectional area, are formed to extend rearward from a point $P_b$. Therefore, when the point $P_b$ and a point $Q_d$ are compared, no difference is found in their cross sectional shapes, etc., and the portions between the points $P_b$ and $Q_d$ do not correspond to the intermediate portions. In a region between the point $P_a$ and the point $P_b$, both the total cross sectional area of the resistor element 30 and the diameter of the imaginary circumscribed circle increase. Therefore, the portions between the points $P_a$ and $P_b$ correspond to the intermediate portions.

Incidentally, in the present invention, which has the above-described structure, preferably, the cross sectional areas $S_{1S}$ and $S_{2S}$ of the ceramic heater 12 at the arbitrary points $P_1$ and $P_2$ satisfy a relation $S_{1S}<S_{2S}$. That is, the outlines 40*g* of the intermediate portions 40, 40 narrow toward the front end along with the outline 60*g* of the substrate 60. Since this configuration reduces the volume of the substrate front end portion, the heat generated by the heat-generating front end portion 50 can be efficiently transmitted to the outer circumferential surface of the substrate 60. Therefore, it is possible to further improve quick heating performance, further reduce power consumption, enhance energization durability, and achieve more uniform heat generation. Further, since the temperature difference between the heat-generating front end portion 50 and the outside of a substrate front end portion 80 decreases, when the substrate front end portion 80 is to be heated to a desired temperature, the resistor element 30 does not need to generate heat excessively. As a result, the ceramic heater 12 is excellent in durability. Furthermore, at the intermediate portions 40, the ratio of the cross sectional area of the resistor element 30 to the cross sectional area of the intermediate portions 40 increases, whereby the stress acting on the resistor element 30 can be mitigated, which contributes to the excellent durability. In the case of conventional ceramic heaters, consideration has been given to employing a structure in which the outline of the substrate 60 narrows toward the front end; however, the shape of the substrate 60, including the shape of the intermediate portions 40, and their synergistic effects have not yet been studied, and no invention was made thereon. The above-described effects are first achieved through the synergistic effects of these configurations.

In the case where the ceramic heater is actually used, the ceramic heater is held by another member for attachment to an object to be heated. This holding is mainly performed by a tubular member 90 formed of metal. The holding structure will be described, while a glow plug 200 is taken as an example. As shown in FIG. 8, the ceramic heater 12 is attached to the metallic tubular member 90 such that a front end portion of the ceramic heater 12 is exposed from the metallic tubular member 90. Since the metallic tubular member 90 is higher in thermal conductivity than ceramic, some of the heat generated by the heat-generating portion 33 of the ceramic heater and transmitted to the tubular member 90 via the ceramic heater itself escapes to the outside without heating the object to be heated. In order to avoid such a problem as well, desirably, the ceramic heater generates heat at the front end thereof in a concentrated manner, to thereby enable effective heating, while suppressing power consumption.

In order to satisfy such desire, the ceramic heater may employ the following third structural feature in addition to the above-described configuration. The thickness of the resistor element 30 shown in FIG. 3(*b*) decreases toward the front end. Specifically, portions of the resistor element 30 located rearward of the point $P_b$ are the lead portions 31 whose cross sectional areas and thickness are approximately constant. The resistor element 30 has a largest thickness $t_{XVmax}$ at the lead portions 31. In the intermediate portions 40, the thickness of the resistor element 30 gradually decreases toward the front end from the point $P_b$ (boundary) (between the points $P_b$ and $P_a$). On the front end side of the intermediate portions 40, the resistor element 30 has a thickness suitable for the heat-generating portion 33, and its front end portion has a hemispherical, rounded shape.

The thickness of the resistor element 30 is determined such that a portion of the resistor element 30 projecting frontward (upward in FIG. 3) from a front end surface 90*f* of the tubular member 90 has a thickness $t_{XVex}$ which is equal to or less than ⅔ the maximum thickness $t_{XVmax}$ of the resistor element 30 (in FIG. 3, at the point $P_1$, the thickness $t_{XVex}$ becomes ⅔ the maximum thickness $t_{XVmax}$). The intermediate portions 40 having such a configuration can prevent the resistor element 30 from generating a large amount of heat at a portion thereof covered by the tubular member 90. Accordingly, the heat generated by the heat-generating portion 33 can be efficiently transmitted to the outer circumferential surface of the substrate 60, whereby quick heating performance can be further enhanced, and power consumption can be further reduced. Further, when the substrate front end portion 80 is to be heated to a desired temperature, the heat-generating portion 33 is not required to generate more heat than necessary. Therefore, the ceramic heater 12 is excellent in durability as well. According, preferably, the resistor element is configured such that the intermediate portions have portions whose thickness $t_{XVex}$ is equal to or less than ⅔ the maximum thickness $t_{XVmax}$ of the resistor element, and a portion of the resistor element whose thickness is 2 $(t_{XVmax})/3$ is located outside the metallic tubular member. Notably, the maximum thickness $t_{XVmax}$ of the resistor element 30 is the thickness as measured at a position located frontward of the electrode takeout portions 77 and 78.

The shape of the resistor element 30 (in particular, the intermediate portions 40) will be described in detail. In order to make the following description clear, FIGS. 5(*a*) and 5(*b*) show, in an exaggerated manner, the characteristic portions of FIGS. 3(*a*) and 3(*b*) through deformation thereof.

As shown in FIGS. 5(*a*) and 5(*b*), the resistor element 30 is composed of the heat-generating portion 33, the intermediate portions 40, and the lead portions 31 disposed in this sequence from the front end side. In the XV direction view of FIG. 5(*a*), the shape of side portions of the intermediate portions 40 located on the outer side with respect to the XD direction (the radial direction) are tapered such that the width of the intermediate portions 40 increases. The outlines 40*g* of the tapered intermediate portions form an angle $\theta_1$ in relation to the axis XA. The length of the intermediate portions 40 as measured along the axis XA direction is represented by $L_1$. Meanwhile, in the XH direction view shown in FIG. 5(*b*), each of the intermediate portions 40 is composed of an intermediate section 40*f* which expands from the front end toward the rear end so as to increase the thickness thereof, and an intermediate section 40*b* which expands less as compared with the intermediate section 40*f*. The outline of the heat-generating portion 33 and that of the lead portions 31 both extend parallel to the axis XA. In such a structure, the larger one of angles formed by the intermediate sections 40*f* and 40*b* in relation to the axis XA is referred to as an angle $\theta_2$. Further, the length (as measured along the axis XA direction) of the intermediate section outline, which forms the angle $\theta_2$, is represented by $L_2$. In the case where the intermediate portion is formed by a plurality of intermediate section outlines, the boundary between the intermediate section outlines may be rounded in some cases. In such a case, tangential lines of the plurality of intermediate section outlines are assumed, and the above-mentioned $\theta_1$, $L_1$, $\theta_2$, and $L_2$ are derived while the intersection of adjacent tangential lines is used as a boundary (see FIG. 6). Further, in the case where the outlines 40*g* of the intermediate portions 40 are not straight (e.g., have an arcuate shape), the boundaries of the intermediate portions 40 are calculated as described above; a straight line which connects the front side end point and the rear side end point of each intermediate portion 40 is assumed; and an angle between the straight line and the axis XA is derived as the above-mentioned angle θ. Further, the distance between the front side end point and the rear side end point of the intermediate portion 40 as measured along the axis XA direction is derived as the above-mentioned L. In FIGS. 5 and 6, in order to facilitate understanding of the shape of the intermediate portions 40, auxiliary lines (chain lines) are provided.

The present embodiment is configured to satisfy a relation $\theta_2>\theta_1$ and a relation $L_1>L_2$. Specifically, $\theta_1=1°$, $\theta_2=25°$, $L_1=3.5$ mm, and $L_2=2.0$ mm. By virtue of this configuration, in the XH direction view in which the U-like shape of the resistor element 30 can be recognized, the resistor element 30 (the intermediate portions 40) has a shape such that it tapers off relatively gradually toward the front end. In contrast, in the XV direction view perpendicular thereto, the resistor element 30 (the intermediate portions 40) has a shape such that it tapers off relatively sharply toward the front end. By virtue of this shape, the resistor element 30 achieves the following effect. Notably, when this shape is formed, preferably, $\theta_1$, $\theta_2$, and $L_1$ are determined to satisfy respective relations $0.5°\leqq\theta_1\leqq5°$, $10°\leqq\theta_2\leqq70°$, and $2.5\text{ mm}\leqq L_1\leqq20$ mm.

As described above, concentration of the heater's heat generation on the front end thereof is desirable from the viewpoint of reduction in power consumption. However, in some cases, heat generation in only a small region of the front end is considered not preferred. In particular, in the case of a glow plug used for heating of a diesel engine, in order to realize efficient combustion, heat is preferably generated over a somewhat large range. In order to meet the incompatible requirements, the ceramic heater 12 of the present embodiment has the above-described configuration. Thus, a relatively large portion of the front end portion of the ceramic heater 12 (in FIG. 3(*a*), a portion located frontward of $P_a$) reaches the highest temperature. Notably, for example, "reaching the highest temperature" means reaching 1200° C. as a result of application of 7 V over 30 sec.

Notably, in order to realize more excellent durability while meeting the above-described requirements, preferably, the outline 60*g* of the substrate 60 is tapered to narrow toward the front end as in the present embodiment, in a region in which the thickness $t_{XVex}$ of the portions of the intermediate portions 40 projecting from the tubular member 90 is equal to or less than $2(t_{XVmax})/3$. Through employment of this configuration in addition to the tapering-off shape of the intermediate portions 40, the outside contours of the pair of intermediate portions 40, 40 become straight and do not have concave and convex portions or the like. Therefore, when voltage is applied to the resistor element 30, it becomes possible to mitigate concentration of thermal stress and local temperature rise. Further, concentration of thermal stress on the heat-generating front end portion 50 can be prevented. Accordingly, the ceramic heater can have excellent quick heating performance, can reach a predetermined temperature while consuming a small amount of electric power, and can have enhanced energization durability.

This will be described with reference to FIG. 5. As described above, the intermediate portions 40 are regions in which the relation $CL_1<CL_2$ and the relation $HS_{1S}<HS_{2S}$ are satisfied. Therefore, the intermediate portions 40 are the regions between $R_1$ and $R_2$. Meanwhile, the "above-mentioned thickness $t_{XVex}$" is the thickness of the intermediate portions 40 at a position $R_3$, which is ⅔ the thickness $t_{XVmax}$ of the lead portions 31. Therefore, the "intermediate portions 40 whose thickness is $t_{XVex}$" are intermediate portions 40*m* between $R_1$ and $R_3$ shown in FIG. 5. In the region between $R_1$ and $R_3$, the outline 60*g* of the substrate 60 has a tapered shape. Thus, the above-described effects are attained.

Preferably, the above-described tapered shape of the substrate 60 is formed as follows. As shown in FIG. 5, in the XV direction view, an angle $\theta_3$ formed between the axis XA and the tapered outline of the substrate 60 is determined to satisfy a relation $|\theta_3-\theta_1|\leqq10°$, more preferably $|\theta_3-\theta_1|\leqq6°$, ideally=0° as shown in FIG. 5. Thus, the heat generated by the heat-generating portion 33 can be efficiently transmitted to the outer circumferential surface of the substrate front end portion 80. Accordingly, it becomes possible to further enhance quick heating performance and further reduce power consumption. As a result, the heat-generating portion 33 does not need to generate more heat than necessary in order to heat the substrate front end portion 80 to a desired temperature. Therefore, the ceramic heater 12 is excellent in durability as well.

In particular, from the viewpoint of performance in starting a diesel engine, the maximum spacing GL between the pair of lead portions 31, 31 is determined to satisfy a relation GL<GM, where GM represents the maximum spacing GL between the portions of the intermediate portions 40, 40 whose thickness $t_{XVex}$ is equal to or less than $2t_{XVmax}/3$. Thus, in a region in which the heat generation temperature is relatively high, the pair of intermediate portions 40, 40 has an increased spacing therebetween, so that the heat generated by the heat-generating portion 33 is efficiently transmitted to the substrate 60, and the amount of heat radiated from the substrate increases. Accordingly, it becomes possible to reduce power consumption while maintaining engine starting performance. Further, since the heat-generating portion 33 does not need to generate more heat than necessary in order to heat the substrate front end portion 80 to a desired temperature, the ceramic heater 12 is excellent in durability as well.

In the above, the structure of the ceramic heater 12 has been described. Next, materials of the ceramic heater 12 and a method of manufacturing the ceramic heater 12 will be described.

An example of an electrically insulative ceramic for forming the substrate 60 of the ceramic heater 12 is silicon nitride ceramic. Also, an electrically conductive mixture of silicon nitride ($Si_3N_4$) and tungsten carbide (WC) is used as an electrically conductive ceramic for forming the resistor element 30. These materials and a method of manufacturing the materials are known, and are described in, for example, Japanese Patent Application Laid-Open (kokai) No. 2008-293804.

That is, material powder for forming the substrate 60 and material powder for forming the resistor element 30 are prepared in advance. A green member which is to become the resistor element 30 is formed through injection molding performed by charging the corresponding material powder into a predetermined mold. The mold used for the injection molding is designed such that the resistor element 30 has the above-described shape. Alternatively, a member obtained through injection molding is machined to obtain a green member of the resistor element 30 having the above-described shape. Meanwhile, the material powder for forming the substrate 60 is charged into a different mold, the molded green member is placed on the charged material powder, and the material powder for forming the substrate 60 is further charged. Subsequently, press forming is performed in a state in which the molded green member is buried in the material powder for forming the substrate 60, whereby the molded green member and the material powder are united, and, thus, a green ceramic heater is produced. After having undergone a predetermined debindering process, etc., the green ceramic heater is fired by means of a hot press. The external shape of a resultant ceramic heater is regulated by use of a grinder or the like. At that time, the machining is performed such that the substrate 60 has the above-described shape.

The ceramic heater 12 manufactured as described above can be used as the glow plug 200 shown in FIG. 8. The glow plug 200 is mainly composed of the ceramic heater 12, the metallic tubular member 90, a housing 93, and a center rod 94. As is well known, the tubular member 90 holds the ceramic heater 12 at its inner circumferential surface, and is fixed to the ceramic heater 12, by means of press-fitting or brazing, such that the tubular member 90 is in contact with the electrode take-out portion 78. A front end portion of the housing 93, which is also a metallic tubular member, is joined to the tubular member 90. An external thread 98 for attachment to an engine is formed in a central region of the outer circumferential surface of the housing 93, and a tool engagement portion 99 is formed at the rear end. When the glow plug 200 is attached to the engine, a tool is engaged with the tool engagement portion 99. The center rod 94, which is formed from metal into a rodlike shape and used to supply electric power to the ceramic heater 12, is provided within the housing 93 such that the center rod 94 passes through the tool engagement portion 99 and is insulated from the housing 93 by an insulating member 95 and an insulating engagement member 96. The center rod 94 may be fixed by use of a crimp member 97 formed of metal. For example, a lead wire 92 is joined to a front end portion of the center rod 94 fixed as described above, and electric power is supplied to the ceramic heater 12 via the lead wire 92. In the example of FIG. 8, a ring member 91 formed of metal is fitted onto the rear end of the ceramic heater 12 in order to facilitate the connection with the lead wire 92.

Needless to say, this example is one example of the embodiment of the ceramic heater according to the present invention, and the invention is not limited thereto.

EXAMPLE 1

Fabrication of the Ceramic Heater

WC (average grain size: 0.7 μm), silicon nitride (average grain size: 1.0 μm), and $Er_2O_3$ (sintering aid) were wet-blended in a bowl mill for 40 hours, whereby a powder mixture for forming the resistor element was obtained (the WC content of the powder mixture was adjusted within a range of 27 vol. % (63 mass %) to 32 vol. % (70 mass %), whereby the room temperature resistance of a completed heater became about 300 mΩ or higher). The powder mixture for forming the resistor element was dried by a spray dry method so as to prepare powder for granulation. Binder was added to the powder for granulation such that the binder was present in an amount of 40 to 60 vol. %, and the powder was kneaded for 10 hours in a kneader. After that, granules having a grain size of about 3 mm were formed from the obtained mixture by use of a pelletizer. The formed granules were placed in an injection molding machine having a mold capable of forming intermediate portions of Examples 1 to 15 and Comparative Example 1, and a green resistor element having a green heat-generating portion to become a heat-generating portion satisfying the above-described conditions was obtained through injection molding.

Meanwhile, silicon nitride (average grain size: 0.6 μm), $Er_2O_2$ (sintering aid), and $CrSi_2$, $WSi_2$, and SiC (thermal expansion adjusters) were wet-blended in a bowl mill, whereby a powder mixture was obtained. Binder was added to the powder mixture, and the resultant mixture was dried by a spray dry method, whereby a substrate-forming powder mixture for forming the substrate was obtained.

Next, the green resistor element was embedded into the substrate-forming powder mixture, which was then press-formed, whereby a molded product to become a ceramic heater was obtained. This molded product was calcined for debindering at 800° C. for one hour in a nitrogen atmosphere, and was fired by a hot press method at 1780° C. under a pressure of 30 MPa for 90 minutes in a nitrogen atmosphere of 0.1 MPa, whereby a fired product was obtained. The obtained fired product was ground into the form of an approximate cylinder having a diameter of 3.1 mm. Further, as desired, the substrate front end portion 80 was tapered, polished, or polished into a rounded shape, whereby each of ceramic heaters shown in Table 1 was manufactured. The manufactured ceramic heaters have shapes identical with that of the above-described ceramic heater 12. However, the ceramic heaters may have modified shapes shown in FIG. 7. These modified shapes will be described later. Example dimensions of the manufactured ceramic heaters are as follows: the overall length of the ceramic heater (the length along the axis XA direction) is 30 to 50 mm, the diameter of the ceramic heater 12 (constant diameter portion 70) is 2.5 to 3.2 mm, the minimum wall thickness of the ceramic heater (excluding the substrate front end portion 80) is 100 to 500 vim, the length of the substrate front end portion 80 along the axis XA direction is 1 to 20 mm, and the spacing between the paired lead portions 31, 31 is 0.2 to 1 mm.

The above-described glow plug was manufactured by use of each of the manufactured ceramic heaters, and subjected to various performance evaluation tests, which will be described next. Notably, the characteristic values of the ceramic heaters are also shown in Table 1.

(Measurement of Power Consumption of Glow Plug)

An apparatus shown in FIG. 10 was used so as to measure the surface temperatures and power consumptions of these glow plugs. The apparatus shown in FIG. 10 includes a controller 100; a DC power supply 101 connected to the controller 100; an oscilloscope 105 connected to the DC power supply 101; a radiation thermometer 104 and a personal computer 106 connected to the oscilloscope 105; and wires extending from the DC power supply 101. Notably, the chart below shows the details of the apparatus used for measuring the surface temperature and power consumption of glow plugs.

| | NAME | PRODUCT NAME | MANU-FACTURER | DETAILS |
|---|---|---|---|---|
| 100 | CONTROLLER | GLOW PLUG TEST CONTROLLER | NIPPO ELECTRONIC IND. LTD. | TYPE GPT-F1B |
| 101 | DC POWER SUPPLY | EX-760L2 | TAKASAGO | EXTENDED RANGE DC POWER SUPPLY |
| 102 | RADIATION THER-MOMETER | INFRARED THER-MOMETER | IRCON | MODLINE 6000 SERIES |
| 103 | RADIATION THER-MOMETER MAIN BODY | INFRARED THER-MOMETER | IRCON | MODLINE PLUS |
| 105 | OSCIL-LOSCOPE | DL716 16CH DIGITAL SCOPE | YOKOGAWA | SUFFIX: -M-HJ/M1/C10 |

-continued

| | NAME | PRODUCT NAME | MANU-FACTURER | DETAILS |
|---|---|---|---|---|
| 106 | PERSONAL COMPUTER | NEC VersaPro Genuine Intel x86 Family 6 Model 8 Stepping 3 | NEC | OS: Microsoft Windows 98 SE MODEL 701830 |

The surface temperature and power consumption of each of the glow plugs of Examples and Comparative Example 1 were measured by use of the apparatus shown in FIG. 10. Specifically, each glow plug 200 was connected to the wires of the apparatus, and the voltage applied to the glow plug 200 was set at the controller 100. The controller 100 controlled the DC power supply 101 to thereby control the voltage applied to the glow plug 200. By use of the radiation thermometer 104, composed of a camera 102 and a main body 103, the surface temperature of the ceramic heater of the glow plug was measured (emissivity: 0.935). At that time, the current flowing through each glow plug was controlled such that the surface temperature of the glow plug became 1200° C. The electric power supplied in a controlled manner was calculated as power consumption by a method which will be described later.

Further, the voltage applied from the DC power supply 101 to each glow plug and the current flowing through each glow plug were monitored by use of the oscilloscope 105, and the measured temperature, measured as the surface temperature of the ceramic heater by the radiation thermometer 104, was monitored. The oscilloscope 105 can record data of the measured temperature, the applied voltage, and the current in a synchronized manner, while using the applied voltage as a trigger. The data obtained in this manner were processed in the personal computer 106, to thereby calculate the power consumption. Tables 1 and 2 show the results.

(Energization Durability Test for Glow Plug)

An energization durability test was carried out for the glow plugs of Examples and Comparative Example 1. The energization durability test was carried out by repeating a heating and cooling cycle in which a heater voltage was applied to each glow plug such that the heater temperature increased at a rate of 1000° C./sec until the temperature reached a highest temperature of 1350° C. or 1450° C., and the application of voltage was stopped, and the glow plug was cooled by a fan for 30 sec. The heating and cooling cycle was ended when the number of repeated cycles reached 100000. When the resistance changed 10% or more before the number of repeated cycles reached 100000, the test was ended. In this test, a glow plug for which the heating and cooling cycle was repeated over 35000 times was evaluated "Excellent (AA)"; a glow plug for which the heating and cooling cycle was repeated over 15000 times was evaluated "Good (BB)"; and a glow plug for which the heating and cooling cycle was repeated over 5000 times was evaluated "Fair (CC)." The results of this test are shown in Tables 1 and 2.

(Quick Heating Performance Test for Glow Plug)

A quick heating performance test was carried out for the glow plugs of Examples and Comparative Example 1. A DC voltage of 11 V was applied to each glow plug, and the temperature of a hottest-generating portion 21 of the outer circumferential surface of the ceramic heater was measured. A time required to reach 1000° C. was measured as a 1000° C. reaching time, on the basis of which quick heating performance was evaluated. The results of this test are shown in Tables 1 and 2.

(Engine Startup Test for Glow Plug)

For the glow plugs of Examples, an engine starting test was performed in an environment of −25° C. A glow plug which enabled an engine to reach 950 rpm within 10 sec was evaluated "Excellent (AA)"; and a glow plug which enabled the engine to reach 950 rpm within 15 sec was evaluated "Good (BB)." The results of this test are shown in Table 2.

TABLE 1

| | Shape of ceramic heater | | | | | | | Test results | | | |
|---|---|---|---|---|---|---|---|---|---|---|---|
| | Difference in diameter of circumscribed circle of intermediate portions (mm) | Cross sectional area S1 ($mm^2$) | Cross sectional area S2 ($mm^2$) | Difference in diameter of inscribed circle of intermediate portions (mm) | Cross sectional area of resistor at hottest heat generation portion ($mm^2$) | Cross sectional area ratio (hottest heat generation portion/lead portion) | Shape | Power consumption (Wh) | Energization durability | Resistance at room temp. (mΩ) | Quick heating performance (sec) |
| Ex. 1 | 1.7 | 1.8 | 7.5 | 0.4 | 0.4 | 1/9.3 | 1 | 33 | AA | 437 | 0.4 |
| Ex. 2 | 1.3 | 2.8 | 7.5 | 0 | 0.4 | 1/9.3 | 2 | 41 | AA | 455 | 0.7 |
| Ex. 3 | 0.8 | 4.5 | 7.5 | −0.6 | 0.4 | 1/9.3 | 6 | 47 | AA | 501 | 1.3 |
| Ex. 4 | 1.7 | 2.8 | 7.5 | 0.4 | 0.4 | 1/9.3 | 7 | 38 | AA | 438 | 0.8 |
| Ex. 5 | 1.7 | 8.6 | 8.6 | 0.4 | 0.4 | 1/9.3 | 8 | 44 | AA | 425 | 1.2 |
| Ex. 6 | 1.7 | 8.6 | 8.6 | 0.4 | 0.4 | 1/9.3 | 9 | 46 | AA | 444 | 1.5 |
| Comp. Ex. 1 | 0 | 8.6 | 8.6 | −1 | 1.1 | 1/2.8 | 24 | 62 | AA | 433 | 3.1 |

TABLE 2

| | $t_{XVex}/t_{XVmax}$ | Angle $\theta_3$ (°) | Angle $\theta_1$ (°) | Angle difference (°) $\lvert\theta_3-\theta_1\rvert$ | Spacing difference GM − GL (mm) | Resistance at room temp. (m ( ) | Power consumption (W) | Energization durability 1350 (C. | Energization durability 1450° C. | Quick heating performance (sec) | Engine startup time |
|---|---|---|---|---|---|---|---|---|---|---|---|
| Ex. 1 | 1/3 | 7.5 | 7.5 | 0 | −0.4 | 437 | 33 | AA | AA | 0.4 | BB |
| Ex. 7 | 2/3 | 1 | 1 | 0 | 0.5 | 292 | 40 | AA | AA | 0.9 | AA |
| Ex. 8 | 1/3 | 1 | 1 | 0 | 0.5 | 312 | 35 | AA | AA | 0.6 | AA |
| Ex. 9 | 3/4 | 1 | 1 | 0 | 0.5 | 323 | 43 | AA | AA | 1.2 | AA |
| Ex. 10 | 1/3 | 1 | 1 | 0 | 0.5 | 334 | 43 | AA | AA | 1.2 | AA |
| Ex. 11 | 1/3 | 2 | 7 | 5 | 0.5 | 313 | 38 | AA | BB | 0.9 | AA |
| Ex. 12 | 1/3 | 2 | 12 | 10 | 0.5 | 325 | 40 | AA | BB | 1.0 | AA |
| Ex. 13 | 1/3 | 2 | 15 | 13 | 0.5 | 333 | 42 | AA | CC | 1.2 | AA |
| Ex. 14 | 1/3 | 11 | 1 | 10 | 0.5 | 313 | 38 | AA | AA | 0.9 | AA |
| Ex. 15 | 1/3 | 15 | 1 | 14 | 0.5 | 310 | 40 | AA | CC | 1.0 | AA |

As is apparent from the results shown in Tables 1 and 2, the glow plugs of Examples whose resistor element has a heat-generating portion including a pair of intermediate portions satisfying the requirement of the above-described first structural feature were found to have excellent quick heating performances, can reduce power consumption, and are excellent in durability. In particular, the glow plugs of Examples 1 to 4 and 7 to 15 which satisfy the requirements of the above-described first and second structural features were able to reduce power consumption while being excellent in quick heating performance and durability. In contrast, the glow plug of Comparative Example 1, which does not satisfy the requirement of the above-described first structural feature, consumed as much power as 62 W.

The "$t_{XVex}/t_{XVmax}$" in Table 2 represents the ratio of the minimum thickness of the intermediate portion 40 to the maximum thickness of the resistor element 30. Comparison among Examples 7 to 9 reveals that, when the degree of thinness of the intermediate portions 40 as compared with the maximum thickness of the resistor element 30 increases; specifically, when the glow plug has the above-described third structural feature, it is possible to improve quick heating performance while reducing power consumption. Specifically, whereas, in Examples 7 and 8, the thickness of the resistor element 30 (the intermediate portions 40) becomes ⅔ at a portion exposed from the tubular member 90 of the ceramic heater, in Example 9, the thickness of the resistor element 30 (the intermediate portions 40) at the exposed portion thereof is ¾ as measured at the beginning of the exposed portion. Therefore, the glow plug of Example 9 consumed a slightly larger amount of power as compared with those of Examples 7 and 8.

Notably, Example 10 is an example for comparison which has the first and second structural features but does not have the third structural feature. That is, the resistor element 30 has a portion whose thickness becomes ⅔ the maximum thickness inside the tubular member 90. Therefore, heat dissipates from the tubular member 90, which slightly lowers the quick heating performance.

The glow plugs of Examples 8 and 11 to 15 were fabricated such that their ceramic heaters had external shapes substantially identical with or similar to the external shape of the ceramic heater 12, in order to check the influence of the angles $\theta_1$ and $\theta_3$ on quick heating performance and power consumption. Comparison among these examples reveals that having the sixth structural feature is preferred.

Moreover, comparison between Example 1 and Examples 7 to 15 of Table 2 reveals that engine starting performance can be improved by setting the relation between the maximum spacing GL between the pair of lead portions 31 and the maximum spacing GM between the intermediate portions 40 having the thickness $t_{XVex}$ to satisfy the relation GL<GM.

As shown in Table 1, Examples of the present invention differ from one another in the difference ($CL_2-CL_1$) between the diameter of the circumscribed circle CG of the intermediate portions 40 at the frontmost end thereof and the diameter of the circumscribed circle CG of the intermediate portions 40 at the rearmost end thereof. Depending on design, a desirable value is selected for the diameter difference. For example, the diameter difference is selected to fall within a range of 0.1 to 2.5 mm, preferably, 0.3 to 2.0 mm. When the diameter difference falls within this range, the outer diameter of the pair of intermediate portions 40 decreases appropriately toward the front end, and their volumes decrease. Therefore, it is possible to improve quick heating performance and further lower power consumption, while maintaining the durability of the heat-generating portion 33.

Further, the hottest-generating portion 55 is preferably formed such that its total cross sectional area becomes 1/60 to 1/2.6 the total cross sectional area of the lead portions 31. Each of the total cross sectional areas is the sum of areas of cross sections of the resistor element 30 taken along a plane perpendicular to the axis XA. When the cross sectional area of the hottest-generating portion 55 falls with the above-described range, excellent quick heating performance, low power consumption, and excellent durability can be realized, and the heating temperature of the hottest-generating portion 55 can be made more uniform. Accordingly, when this ceramic heater 12 is used as the heater of the glow plug 200, the glow plug 200 exhibits excellent quick heating performance, low power consumption, and excellent durability, and also exhibits excellent engine starting performance.

Further, the degree of taper of the substrate 60 is preferably determined such that the ratio of cross sectional area $S_{1S}/S_{2S}$ between the cross sections $S_1$ and $S_2$ of the ceramic heater becomes about 0.1 to 0.9 (preferably, 0.5 to 0.9). With this, the buried position of the heat-generating front end portion 50 becomes neither too close to nor too far from the outer surface of the substrate front end portion 80, and the wall thickness of the substrate front end portion 80 in which the heat-generating front end portion 50 is buried becomes a proper thickness, whereby the heat generated by the heat-generating front end portion 50 can be transmitted to the outer circumferential surface of the substrate 60 more efficiently and more quickly. Thus, it becomes possible to realize higher levels of quick heating performance, low power consumption, and durability.

Moreover, a verification test was carried out so as to verify the effectiveness of the fourth structural feature of the present invention. A test similar to the above-described test was carried out for ceramic heaters fabricated such that they differed from one another in the terms of the angles $\theta_1$ and $\theta_2$ and lengths $L_1$ and $L_2$ of the resistor element. The specifications of the ceramic heaters and the test results are shown in Table 3.

TABLE 3

| | Angle $\theta_1$ (°) | Angle $\theta_2$ (°) | Length $L_1$ (mm) | Length $L_2$ (mm) | Resistance at room temp. (mΩ) | Power consumption (W) | Energization durability 1350° C. | Energization durability 1450° C. | Quick heating performance (sec) | Engine startup time |
|---|---|---|---|---|---|---|---|---|---|---|
| Ex. 8 | 1 | 25 | 14 | 2 | 312 | 35 | AA | AA | 0.6 | AA |
| Ex. 16 | 1 | 2 | 14 | 20 | 292 | 40 | AA | AA | 0.9 | AA |
| Ex. 17 | 3.5 | 3 | 12 | 11 | 293 | 39 | AA | AA | 0.9 | AA |
| Ex. 18 | 3.5 | 2 | 12 | 20 | 291 | 43 | AA | AA | 1.2 | AA |

The ceramic heater of Example 8 satisfies the requirement of the fourth structural feature. That is, the ceramic heater was formed to satisfy the relation $\theta_2>\theta_1$ and the relation $L_1>L_2$. Meanwhile, the ceramic heaters of Examples 16 to 18 were formed such that either one or both of the relations regarding the angle θ and the length L failed to be satisfied. Comparison between Example 8 and Examples 16 to 18 reveals that the ceramic heater of Example 8 can reduce power consumption and is relatively excellent in quick heating performance. This results from configuring the intermediate portions 40 to satisfy the requirement of the sixth structural feature, whereby the resistance of the resistor element 30 concentrates at the heat-generating portion 33 on the front end side.

Modifications of the present invention will be described. The resistor element 30 of the present embodiment has a generally elliptical cross sectional shape. However, the cross sectional shape of the resistor element 30 is not limited thereto, so long as the resistor element 30 is formed through so-called injection molding. For example, the embodiment may be modified without departing from the scope of the present invention such that the resistor element 30 has a generally circular or fan-like cross section, or a rectangular or polygonal cross section with chamfered corners.

Not only the cross sectional shape of the resistor element 30, but also its external shape may be modified. FIG. 7 shows several modifications. Notably, in FIG. 7, for portions which do not require specific description, reference numerals are omitted so as to make the drawing clear.

A ceramic heater 1 shown in FIG. 7(*a*) is formed such that the substrate front end portion 80 has a sharper point as compared with the case of the ceramic heater 12. Accordingly, the heat-generating portion 33 also has a slightly pointed shape to follow the outline of the substrate front end portion 80, and only the frontmost end portion of the resistor element 30 forms a U-like shape. Further, both the inner and outer outlines of the intermediate portions 40 extend straight such the spacing between the pair of intermediate portion 40 decreases toward the front end. By virtue of this configuration, the ceramic heater 1 can reduce power consumption further as compared with the ceramic heater 12.

A ceramic heater 2 shown in FIG. 7(*b*) is identical with the ceramic heater 12, except that the spacing between the pair of intermediate portions 40 is constant and is equal to the spacing between the lead portions 31.

A ceramic heater 3 shown in FIG. 7(*c*) differs from the ceramic heater 2 in terms of the outline 60*g* of a portion of the substrate 60 where the intermediate portions 40 are buried. That is, unlike the ceramic heater 2 in which the outline 60*g* tapers off linearly toward the front end, in the ceramic heater 3, the outline 60*g* tapers off non-linearly such that opposite curved lines form the outline 60*g*. Further, the outlines 40*g* of the intermediate portions 40 are formed to follow the outline 60*g* of the substrate 60. Notably, in contrast to the ceramic heater 3 in which the curved lines are inwardly convex, in a ceramic heater 4 (FIG. 7(*d*)) is configured such that the curved lines are outwardly convex.

In the case of a ceramic heater 5 shown in FIG. 7(*e*), the substrate front end portion 80 has a portion 40*t* which projects straight from the front end of the tapered portion thereof, and the resistor element 30 is formed to follow the shape of the substrate 60 such that the heat-generating portion 33 is located in the projecting portion 40*t*. Since the volume of the front end portion of the heater is small, the temperature increases quickly. Therefore, the structure shown in FIG. 7(*e*) can be employed when quick heating performance is important.

A ceramic heater 6 shown in FIG. 7(*f*) is identical with the ceramic heater 2 except that the spacing between the pair of intermediate portions 40 increases toward the front end. Since this configuration shifts rearward the portion of the resistor element 30 where its width decreases, a portion which reaches the highest temperature expands, whereby an effect of improving the engine starting performance can be attained.

A ceramic heater 7 used in the above-described evaluation test has a shape approximately similar to that of the ceramic heater 2. Different is that the substrate front end portion 80 is formed larger as compared with the ceramic heater 2, and the remaining portion is not changed (not shown).

A ceramic heater 8 is identical with the ceramic heater 2, except that the substrate front end portion 80 has a hemispherical shape (FIG. 7(*g*)). Since the substrate front end portion 80 has a hemispherical shape, the ceramic heater 8 is slightly inferior to the ceramic heater 2 in terms of quick heating performance and power consumption. However, the ceramic heater 8 raises no problem associated with practice of the present invention. Further, a ceramic heater 9 is identical with the ceramic heater 8, except that the substrate front end portion 80 is chamfered (into the shape of a truncated cone) (see FIG. 7(*h*)).

Although the embodiments of the present invention have been described above, other modifications are possible. For example, a ceramic heater 10 shown in FIG. 7(*i*) is formed such that portions of the intermediate portions 40 swell radially outward. Even in such a ceramic heater, the present invention can be practiced. Notably, in the case of a ceramic heater having such a shape, determination of the above-mentioned angle $\theta_1$ becomes difficult in some cases. In such a case, the angle $\theta_1$ is derived as follow. First, boundaries of the intermediate portions are specified in a manner as described above. An imaginary line which passes the boundary on the frontmost end side and the boundary on the rearmost end side (among the specified boundaries) is assumed, and an angle formed between the imaginary line and the axis XA is obtained as the angle $\theta_1$. This method of obtaining the angle $\theta_1$ can be applied not only to the shape shown in FIG. 7(*i*), but also to the case where the outline has a curved or stepped shape.

However, when such a shape is employed, improving the production yield of a manufacturing process becomes difficult. Therefore, needless to say, the intermediate portions are preferably formed to extend straight. In conjunction with the first structural feature, it can be said that "the intermediate portions are preferably formed continuously."

Further, in the present embodiment, the ceramic heater is configured such that both the substrate and the resistor element are formed of ceramic. However, the configuration of the ceramic heater is not limited thereto, and a conventionally known structure may be additionally employed. Specifically, as in a ceramic heater 11 shown in FIG. 7(*j*), the rear end portions of the lead portions 31 are formed of lead wires of metal such as tungsten.

Notably, when the present invention is practiced, a ceramic heater may be formed by use of different types of electrically conductive ceramics. In such a case, a specific design as defined by the present invention may become unnecessary, and the effects achieved by the present invention can be attained relatively easily through employment of a simpler design. However, only when a ceramic heater is formed by use of the single electrically conductive ceramic, management of materials used in manufacture and a manufacture process itself can be facilitated, and the above-described action and effects can be attained. Accordingly, the technical importance of the present invention becomes more significant in ceramic heaters which use the single electrically conductive ceramic. However, it is clear that, when the present invention is applied to ceramic heaters which use different types of electrically conductive ceramics, the ceramic heaters exhibit more preferred characteristics. Therefore, application of the present invention is not limited to ceramic heaters in which the resistor element is formed of the single electrically conductive ceramic. However, the present invention, which provides a configuration crucial to ceramic heaters in which the resistor element is formed of a single electrically conductive ceramic, cannot be easily conceived from the design of a ceramic heater which is formed of different types of electrically conductive ceramics.

DESCRIPTION OF REFERENCE NUMERALS

Figure 1:
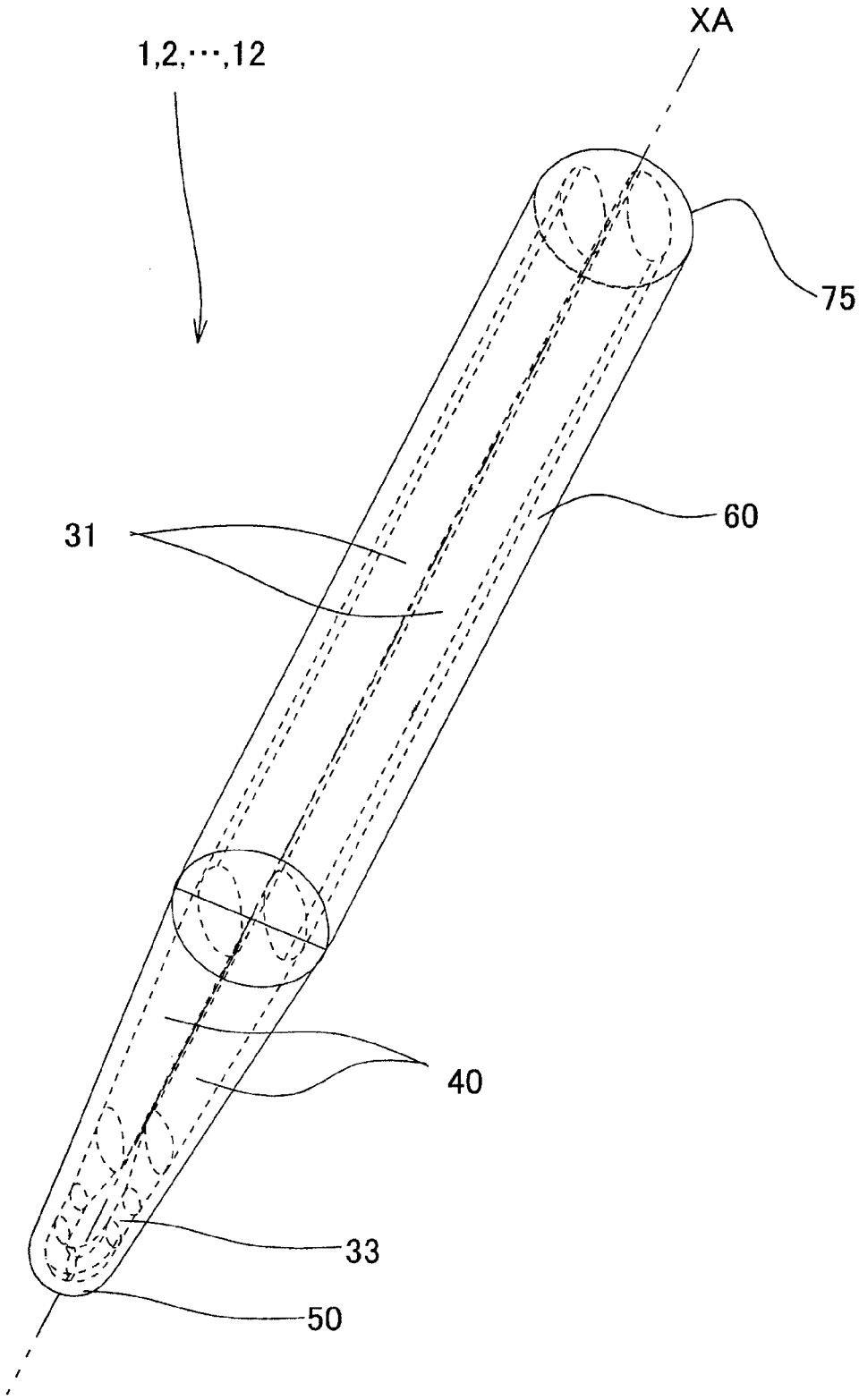
FIG. 1 is a schematic perspective view showing a ceramic heater which is one embodiment of the ceramic heater according to the present invention.
Figure 2:
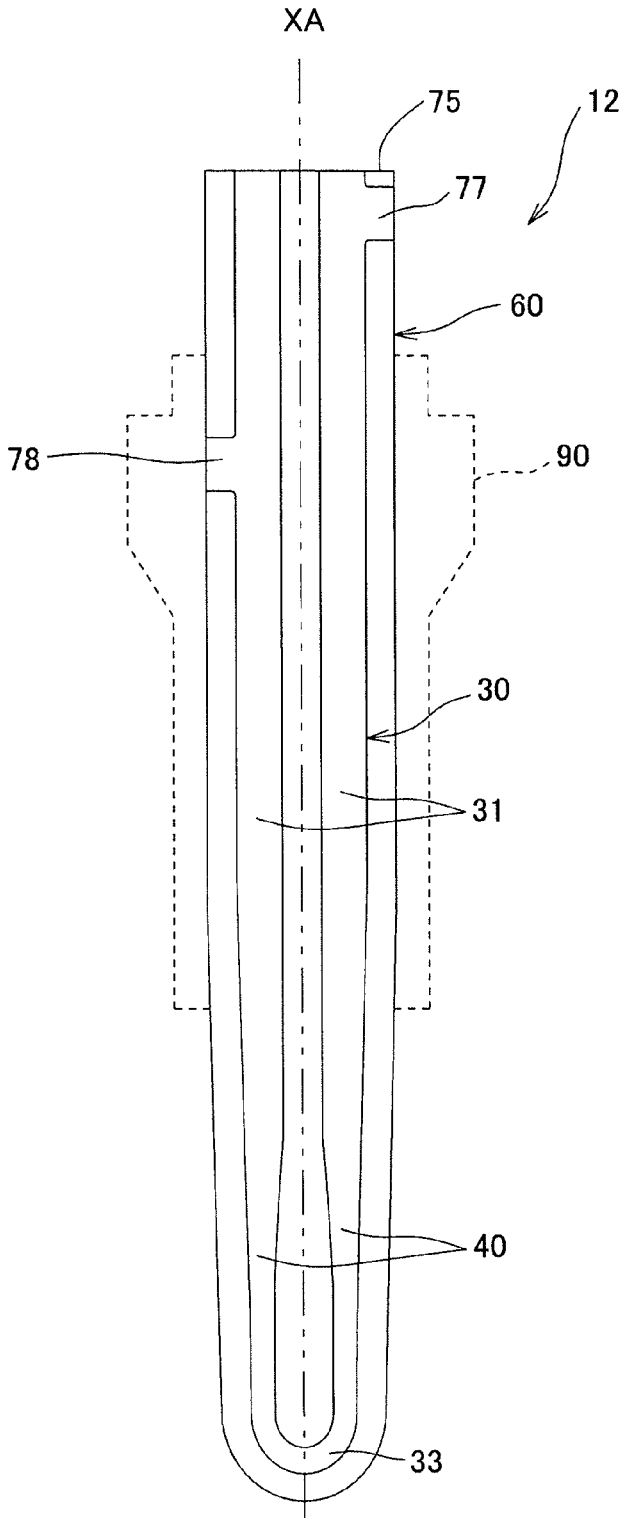
FIG. 2 is a schematic cross sectional view of the ceramic heater, which is the embodiment of the present invention, taken along a plane containing an axis XA.
Figure 3:
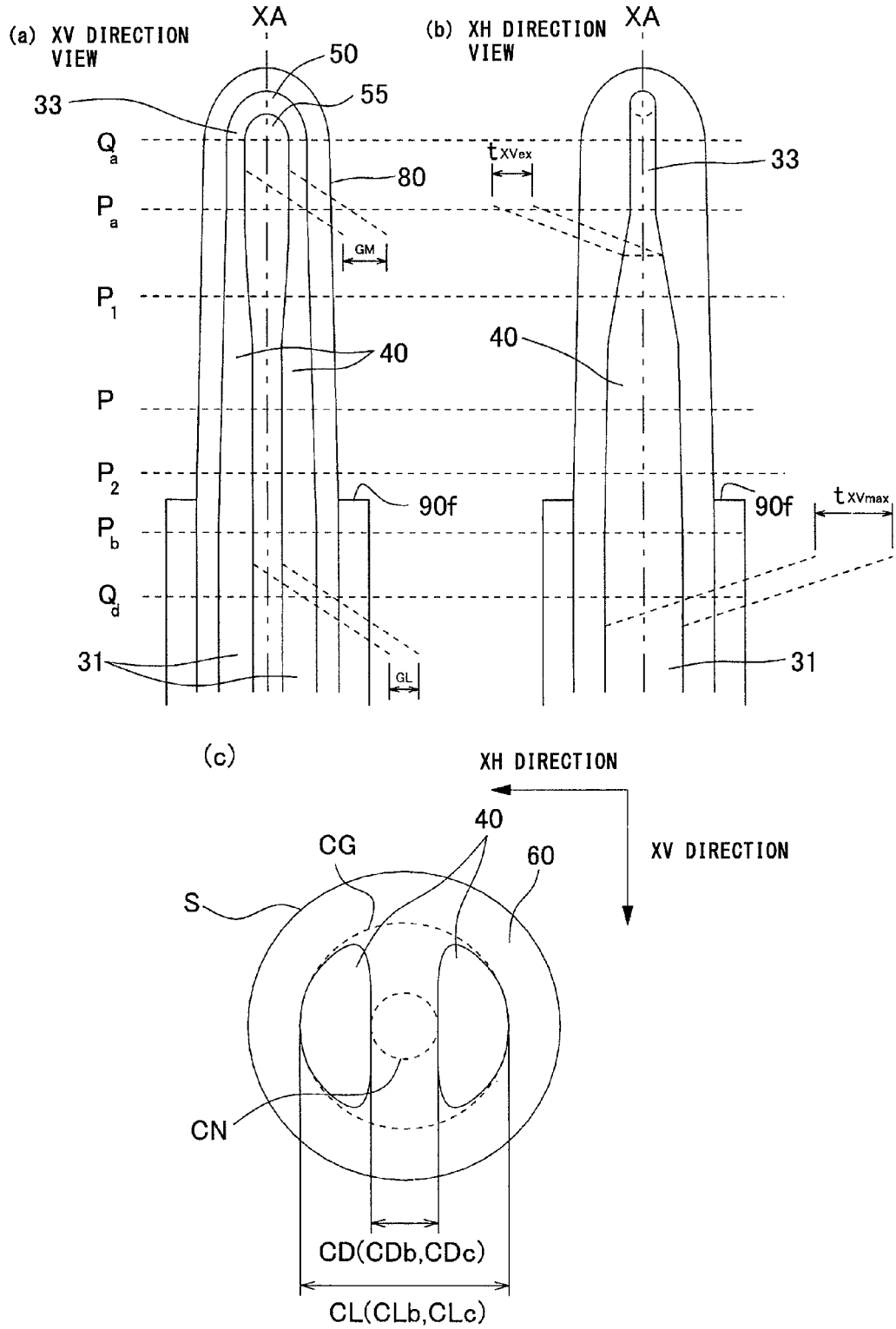
FIGS. 3(*a*), 3(*b*) and 3(*c*) are a set of enlarged cross sectional views showing the embodiment of the ceramic heater according to the present invention.
Figure 4:
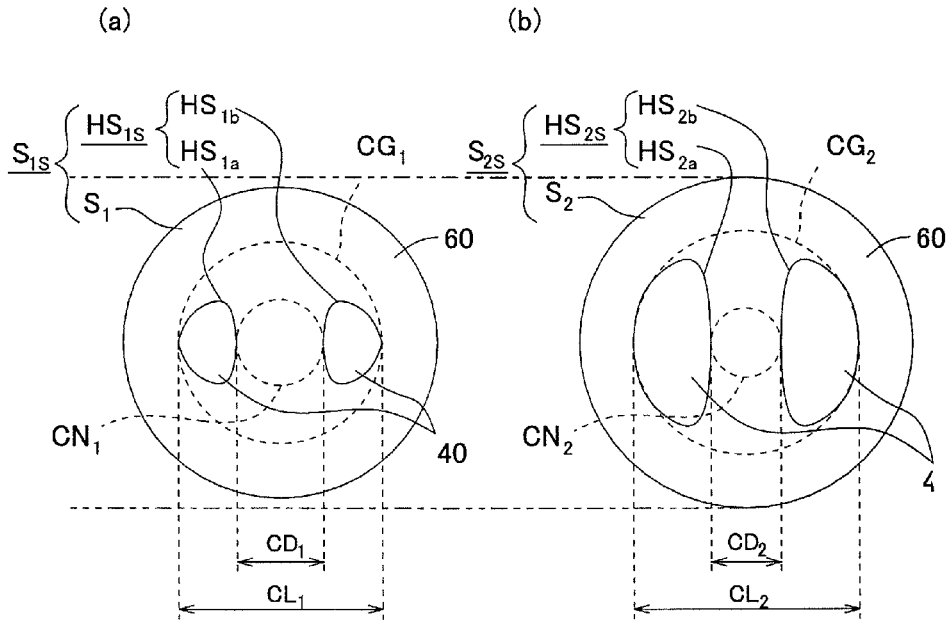
FIGS. 4(*a*) and 4(*b*) are a pair of views relating to the embodiment of the ceramic heater according to the present invention, and each showing a cores section at an arbitrary point P along the axis XA direction.
Figure 5:
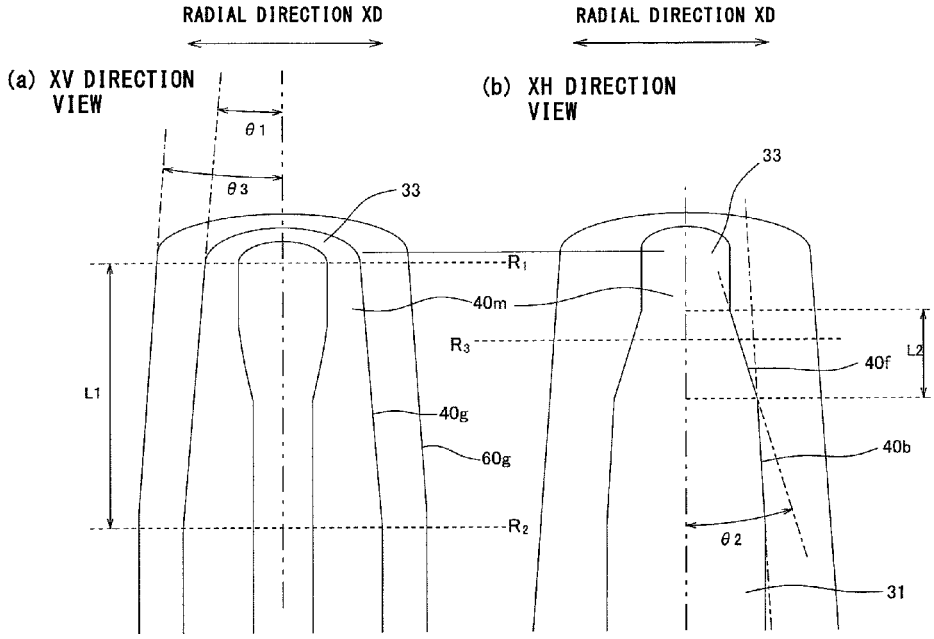
FIGS. 5(*a*) and 5(*b*) are a pair of partial see-through views relating to the embodiment of the ceramic heater according to the present invention, and showing, in an exaggerated manner, characteristic portions in order to describe the shape of the resistor element 30.
Figure 6:
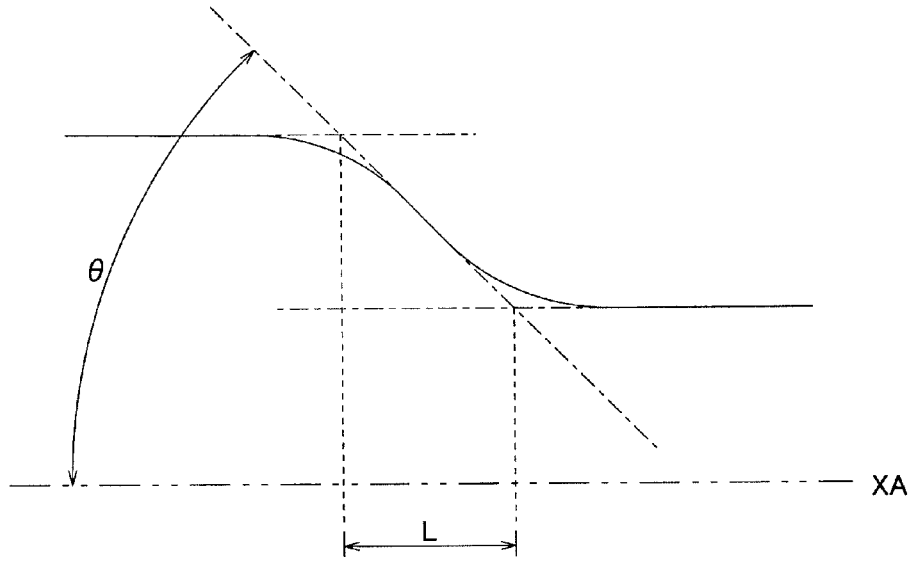
FIG. 6 is a model chart showing tangential lines and intersections therebetween which are assumed when $\theta_1$, $L_1$, $\theta_2$, and $L_2$ are derived.
Figure 7:
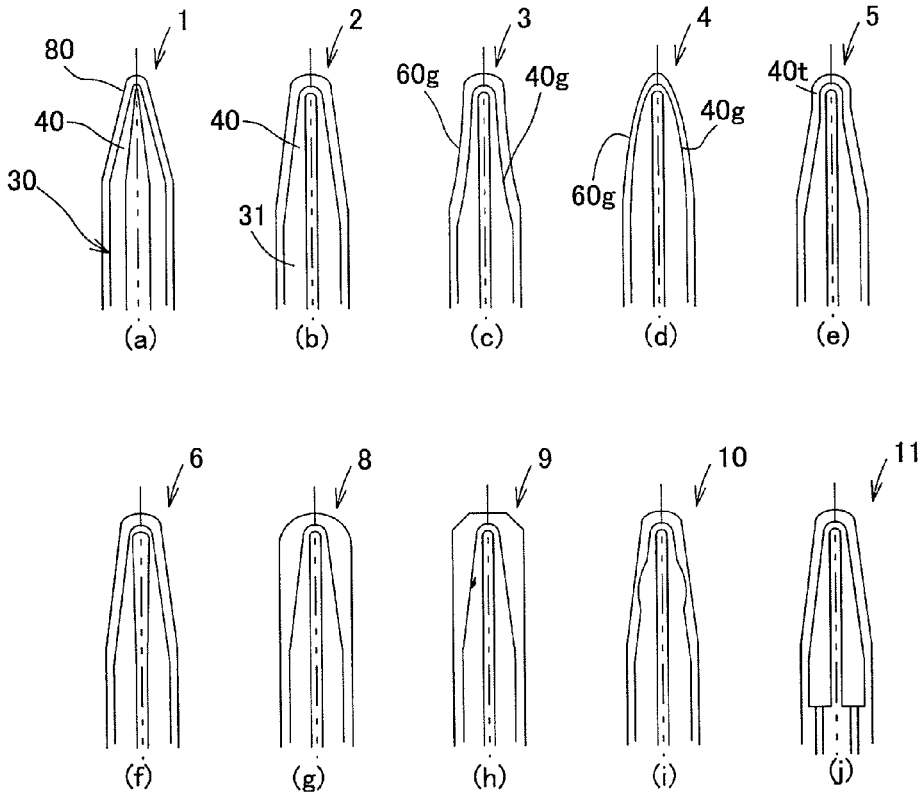
FIG. 7 is a set of views showing modifications of the ceramic heater of the present invention.
Figure 8:
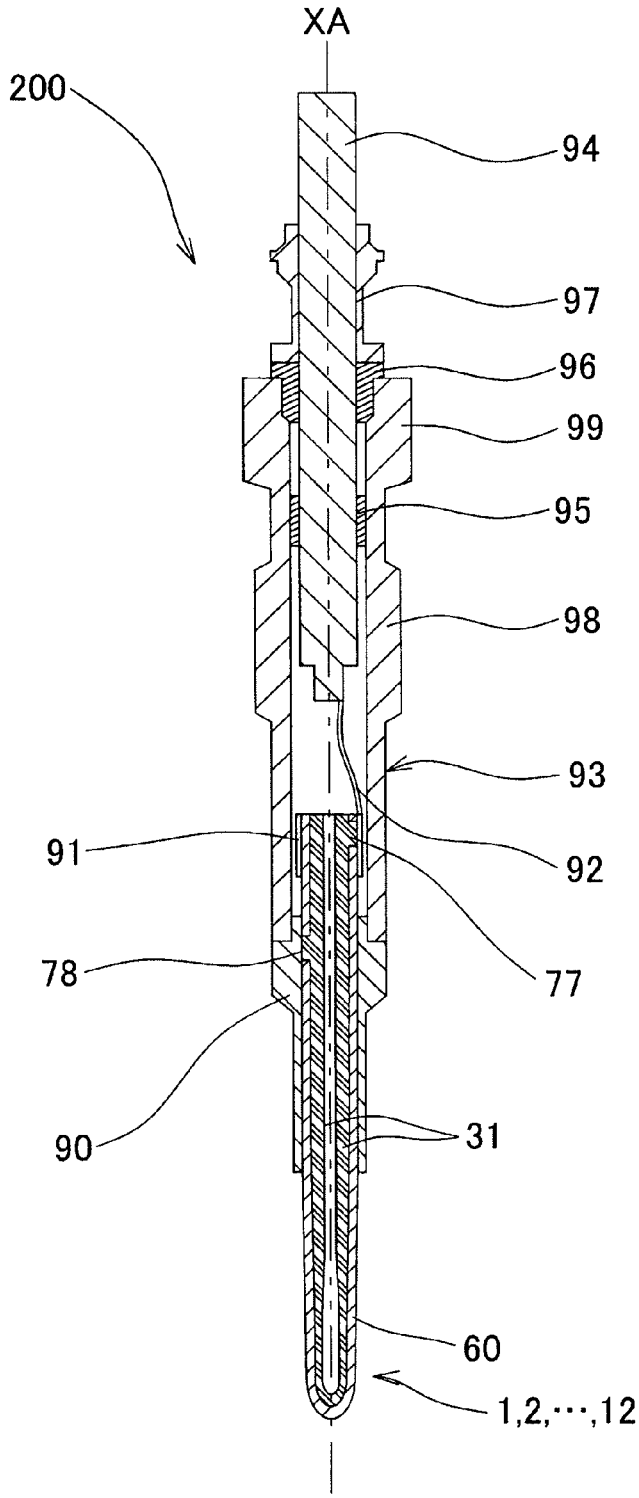
FIG. 8 is a schematic cross sectional view showing a glow plug of one embodiment of the glow plug according to the present invention.
Figure 9:
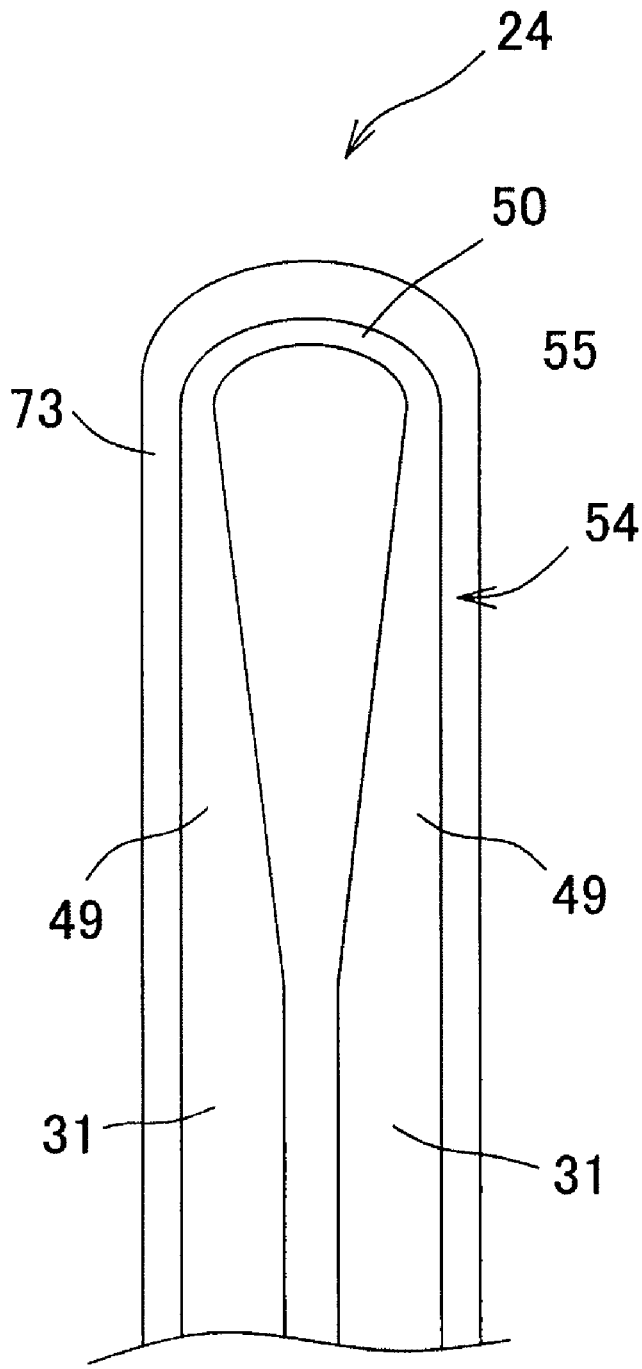
FIG. 9 is an enlarged cross sectional view of a conventional ceramic heater taken along a plane including the axis XA.
Figure 10:
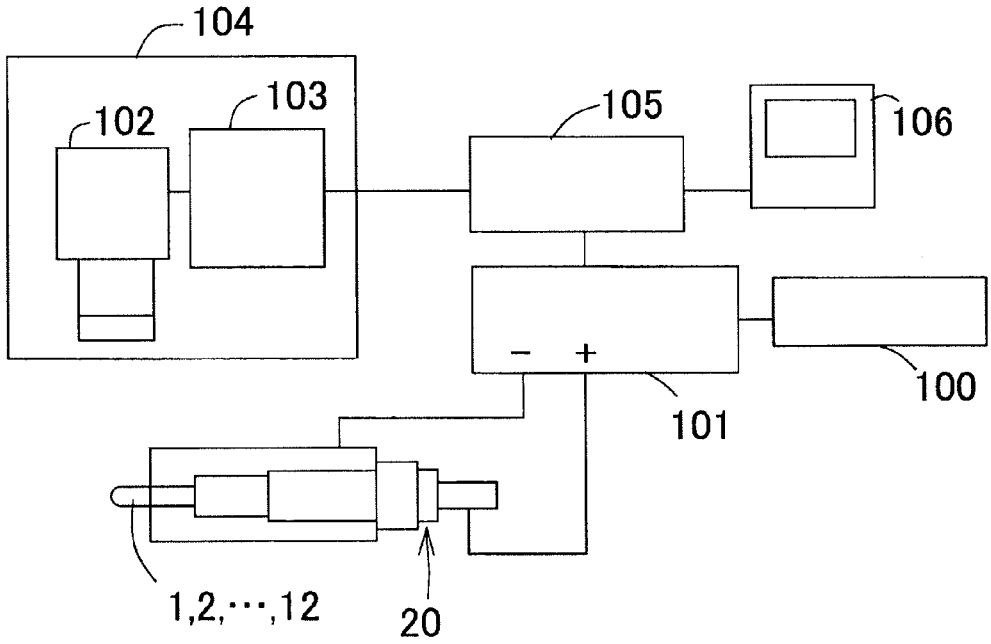
FIG. 10 is an explanatory diagram for roughly explaining the apparatus used for measuring the surface temperature and power consumption of glow plugs.

1 to 12: ceramic heater
200: glow plug
30: resistor element
31: lead portion
33: heat-generating portion
40: intermediate portion
50*g*: outline of the intermediate portion
60: substrate
60*g*: outline of the substrate
90: tubular member

The invention claimed is:

1. A ceramic heater comprising a substrate formed of an electrically insulative ceramic, and a resistor element buried in the substrate, wherein the resistor element includes a single heat-generating portion formed of an electrically conductive ceramic and folded into a U-like shape, and a pair of lead portions which are joined to opposite end portions of said heat-generating portion, the end portion facing rearward with respect to a direction of an axis XA, and which extend straight rearward with respect to the direction of the axis XA, the ceramic heater being characterized in that said resistor element includes intermediate portions located between said heat-generating portion and said lead portions;

when, on cross section $S_1$ and $S_2$ of said ceramic heater taken along a plane perpendicular to said axis XA at a front end side point $P_1$ and a rear end side point $P_2$, which are arbitrary two different points on said axis XA, imaginary circumscribed circles $CG_1$ and $CG_2$ are drawn such that the imaginary circumscribed circles $CG_1$ and $CG_2$ circumscribe and contain two cross sections $HS_{1a}$ and $HS_{1b}$ and two cross sections $HS_{2a}$ and $HS_{2b}$, respectively, of said resistor element appearing on the cross section $S_1$ and $S_2$, respectively, diameter $CL_1$ and $CL_2$ of the circumscribed circles $CG_1$ and $CG_2$ satisfy a relation $CL_1<CL_2$; and the total cross sectional area $HS_{1S}$ of the two cross sections $HS_{1a}$ and $HS_{1b}$ of said resistor element and the total cross sectional area $HS_{2S}$ of the two cross sections $HS_{2a}$ and $HS_{2b}$ of said resistor element satisfy a relation $HS_{1S}<HS_{2S}$; and wherein said ceramic heater is inserted into and held in a tubular member formed of metal such that a front end portion of said ceramic heater is exposed;

each of said intermediate portions has a portion having a thickness $t_{XVex}$ equal to or less than ⅔ a maximum thickness $t_{XVmax}$ of said resistor element; and a portion of said resistor element whose thickness is 2 $(t_{XVmax})/3$ is exposed from said tubular member formed of metal.

2. A ceramic heater according to claim 1, wherein cross sectional areas $S_{1S}$ and $S_{2S}$ of the cross sections $S_1$ and $S_2$ of said ceramic heater satisfy a relation $S_{1S}<S_{2S}$.

3. A ceramic heater according to claim 1, wherein an outline of said substrate in which the portions of said intermediate portions having the thickness $t_{XVex}$ are buried is tapered off toward the front end thereof.

4. A ceramic heater according to claim 1, wherein a maximum spacing GL between said pair of lead portions and a maximum spacing GM between said intermediate portions having the thickness $t_{XVex}$ satisfy a relation GL<GM.

5. A glow plug including a ceramic heater according to claim 1.

6. A ceramic heater comprising a substrate formed of an electrically insulative ceramic, and a resistor element buried in the substrate, wherein the resistor element includes a single heat-generating portion formed of an electrically conductive ceramic and folded into a U-like shape, and a pair of lead portions which are joined to opposite end portions of said heat-generating portion, the end portion facing rearward with respect to a direction of an axis XA, and which extend straight rearward with respect to the direction of the axis XA, the ceramic heater being characterized in that said resistor element includes intermediate portions located between said heat-generating portion and said lead portions;

when, on cross section $S_1$ and $S_2$ of said ceramic heater taken along a plane perpendicular to said axis XA at a front end side point $P_1$ and a rear end side point $P_2$, which are arbitrary two different points on said axis XA, imaginary circumscribed circles $CG_1$ and $CG_2$ are drawn such that the imaginary circumscribed circles $CG_1$ and $CG_2$ circumscribe and contain two cross sections $HS_{1a}$ and $HS_{1b}$ and two cross sections $HS_{2a}$ and $HS_{2b}$, respectively, of said resistor element appearing on the cross section $S_1$ and $S_2$, respectively, diameter $CL_1$ and $CL_2$ of the circumscribed circles $CG_1$ and $CG_2$ satisfy a relation $CL_1<CL_2$; and the total cross sectional area $HS_{1S}$ of the two cross sections $HS_{1a}$ and $HS_{1b}$ of said resistor element and the total cross sectional area $HS_{2S}$ of the two cross sections $HS_{2a}$ and $HS_{2b}$ of said resistor element satisfy a relation $HS_{1S}<HS_{2S}$, wherein a relation $\theta_2>\theta_1$ and a relation $L_1>L_2$ are satisfied, where $\theta_1$ represents an angle formed between said axis XA and each of radially outer side outlines of said intermediate portions which outlines determine a width of said intermediate portions, $L_1$ represents a length of said intermediate portions as measured along the direction of said axis XA, $\theta_2$ represents a largest angle among angles formed between said axis XA and radially outer side outlines of said intermediate portions which outline determine a thickness of said intermediate portions, and $L_2$ represents a length of the outlines of said intermediate portions forming the largest angle, as measured along the direction of said axis XA.

7. A ceramic heater according to claim 6, wherein cross sectional areas $S_{1S}$ and $S_{2S}$ of the cross sections $S_1$ and $S_2$ of said ceramic heater satisfy a relation $S_{1S}<S_{2S}$.

8. A ceramic heater according to claim 6, wherein said angle $\theta_1$ and an angle $\theta_3$ satisfy a relation $|\theta_3-\theta_1|\leqq 10°$, where the angle $\theta_3$ represents an angle formed, between said axis XA and an outline of said substrate at a position along the direction of said axis XA where said intermediate portions are located.

9. A glow plug including a ceramic heater according to claim 6.

* * * * *